US005165149A

United States Patent [19]

Nihei

[11] Patent Number: 5,165,149

[45] Date of Patent: Nov. 24, 1992

[54] BUCKLE FOR AUTOMOBILE SEAT BELT

[76] Inventor: Masahide Nihei, 2082-1, Hiharu, Kounan-machi, Oosato-gun, Saitama-ken, Japan

[21] Appl. No.: 660,038

[22] Filed: Feb. 26, 1991

[51] Int. Cl.[5] ..... A44B 11/26

[52] U.S. Cl. ..... 24/633

[58] Field of Search ..... 24/633, 636, 637–642; 297/482

[56] References Cited

U.S. PATENT DOCUMENTS 3,568,268 3/1971 Cunningham ..... 24/641
4,566,160 1/1986 Gavagan et al. ..... 24/637

FOREIGN PATENT DOCUMENTS 2732401 1/1978 Fed. Rep. of Germany ..... 24/642
600009 4/1978 U.S.S.R. ..... 24/641

*Primary Examiner*—James R. Brittain
*Attorney, Agent, or Firm*—Wenderoth, Lind & Ponack

[57] ABSTRACT

A seat belt buckle and seat belt buckle attachments are disclosed, and are designed in such a manner that the seat belt can be put on quickly and smoothly. That is, the seat belt buckle and seat belt buckle attachments are provided with trumpet-like guide members which serve to guide a seat belt tongue into the seat belt buckle for engagement therewith. The seat belt buckle attachments are provided with securing elements for securing the guide members to the respective buckles.

17 Claims, 5 Drawing Sheets

BUCKLE FOR AUTOMOBILE SEAT BELT

BACKGROUND OF THE INVENTION

Various modifications of automobile seat belts have been proposed. Presently, 3-point seat belts are frequently used to restrain the waists and upper bodies of automobile occupants.

In such seat belt units which continuously restrain the body of the occupant in a vehicle from waist to upper body, a tongue is mounted on the end of the belt and one end of the tongue is removably inserted and engaged in a buckle, which is fixed to the vehicle. This buckle comprises a tongue inlet for receipt of the tongue, a fixing means for automatically fixedly engaging the tongue after the tongue has been inserted into the tongue inlet, and an automatic releasing means for releasing the engaged and fixed status of the tongue when necessary.

Normally, when a driver wants to put on his seat belt before starting the car or, if necessary, during driving, the seat belt is pulled out and across the desired portions of the driver's body. Then, the tongue on the end of the seat belt is visually inserted into the tongue inlet and is engaged and fixed by the fixing means.

Although many traffic laws require automobile occupants to wear seat belts, drivers are often seen driving without wearing their seat belts.

One of the reasons for this is that it is often difficult for a driver to put the seat belt on during driving.

In general, the seat belt should be put on before starting the car, but it is often not easy for a driver, especially a fat driver, to back the car out of a garage and onto the road while looking rearwardly of the car when he is wearing his seat belt. In many cases, the driver wants to put the seat belt on after he has driven the car onto the open road. However, due to the difficulties involved in putting the seat belt on while driving, cars are often driven without the seat belts being worn. That is, after the car is driven out to the open road, the driver must be careful of the other running cars and does not have enough time to put his seat belt on. As the result, many drivers drive cars on public roads without wearing their seat belts.

In addition, many drivers who begin driving their cars without wearing their seat belts would like to put their belts on at the first intersection while waiting for the traffic signal to change. Very often, however, there is insufficient time to allow a driver to put his seat belt while waiting at a traffic signal. It is also very difficult to put a seat belt on while watching the road ahead. In many cases, it is necessary for the driver to watch the tongue inlet in order to engage the tongue in the buckle of the seat belt. This is very dangerous.

It is a widely known fact that many drivers have had such experiences. This is also evident from the fact that there are notices near many expressway entrances reminding automobile occupants to wear their seat belts.

Whether it be before starting to drive a car or during driving of the car, it is troublesome and often dangerous to put seat belts on because the driver must watch the tongue inlet to engage the tongue in the buckle of the seat belt. Above all, for professional drivers such as drivers of express delivery services, who frequently get on and off trucks, it is very troublesome to put seat belts on by watching the tongue inlet to engage the tongue in the seat belt buckle.

SUMMARY OF THE INVENTION

The object of the present invention is to offer a buckle for a seat belt of a vehicle, by which it is possible to smoothly and easily insert, engage and fix the tongue on the end of the belt into the buckle while watching the traffic on the road ahead and without looking at the tongue inlet to engage the tongue in the seat belt buckle. It is also an object of the invention to prevent traffic accidents which may occur during an attempt to put a seat belt on. The situations in which seat belts are normally put on include situations in which the driver wants to put on the seat belt before starting the car, the driver drives the car out to an open road without putting the seat belt on and unavoidably drives the car without wearing the seat belt, and the driver wants to put the seat belt on at an intersection while waiting for a traffic signal to change because he has not had enough time to put on the seat belt.

DETAILED DESCRIPTION OF THE PREFERRED EMBODIMENTS

A description of the invention will now be given in connection with the drawings.

Figure 1:
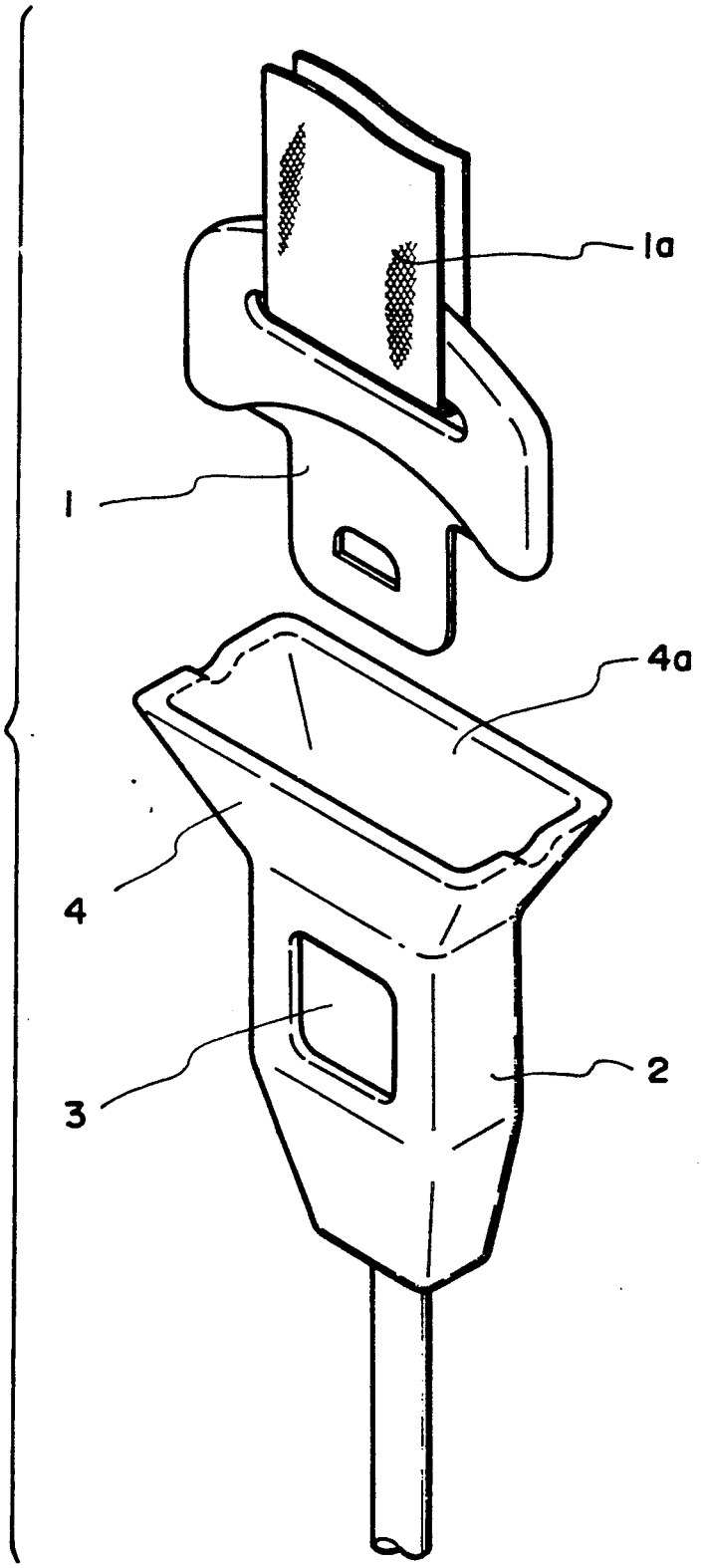
FIG. 1 is a perspective view showing an embodiment of a buckle for an automobile seat belt according to the present invention.

In FIG. 1, 1 represents a tongue mounted on an end of seat belt la for restraining the waist and upper body of a driver, and 2 is a buckle for the seat belt into which the above tongue 1 can be inserted, engaged and fixed.

The seat belt buckle 2 has an opening *2a* for insertion of the tongue, an automatic engaging means (not shown) for engaging the tongue 1 when the tongue 1 is inserted into the opening *2a*, and an automatic releasing means 3 for releasing the engaged and fixed status of the tongue 1.

A guide member 4 is provided to aid in inserting the tongue and includes a trumpet-like opening *4a*, the diameter (or periphery) of which gradually increases toward the direction of the insertion of the tongue 1 and gradually decreases toward the buckle body 2. In the present embodiment, the guide member 4 is integrally formed on an upper portion of the buckle 2.

It is needless to say that this guide member 4 can be formed separately from the buckle 2 or can be formed as an auxiliary member to be mounted on an existing buckle 2. The details will be described below in connection with the embodiments.

Figure 2:
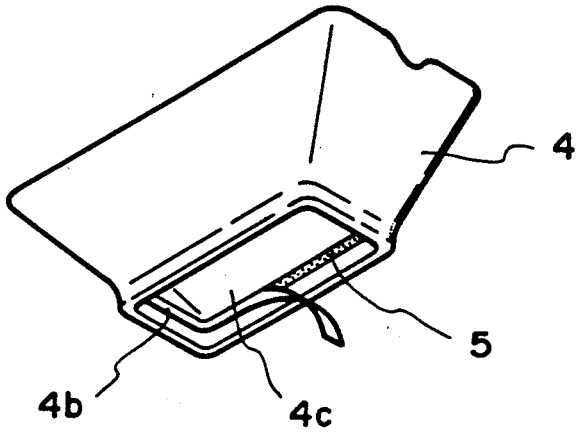
FIG. 2 is a perspective view showing an embodiment of an auxiliary guide member for mounting on a buckle of an automobile seat belt, according to the present invention.
Figure 3:
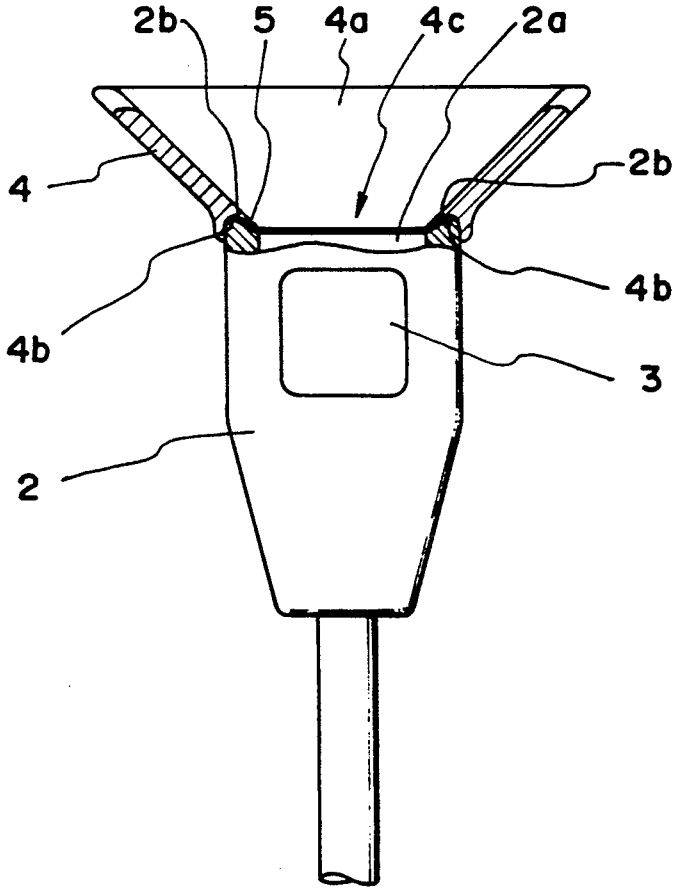
FIG. 3 is a partially cut away front view showing the guide member of F 2 mounted to the buckle.

In the embodiment shown in FIGS. 2 and 3, the trumpet-like guide member 4 is formed separately from the buckle. A peripheral portion 4*b* is formed at the base end of the guide member 4 near a lower portion 4*c* of the opening 4*a* to engage with a periphery 2*b* of the opening 2*b* of the buckle 2. The separately formed guide member is engaged, bonded and fixed to the buckle 2 with a double-sided adhesive tape 5 having release paper on both sides. Although not shown in the drawings, the engagement member formed on the guide member can be engaged with the engagement member formed on the buckle 2.

Figure 4:
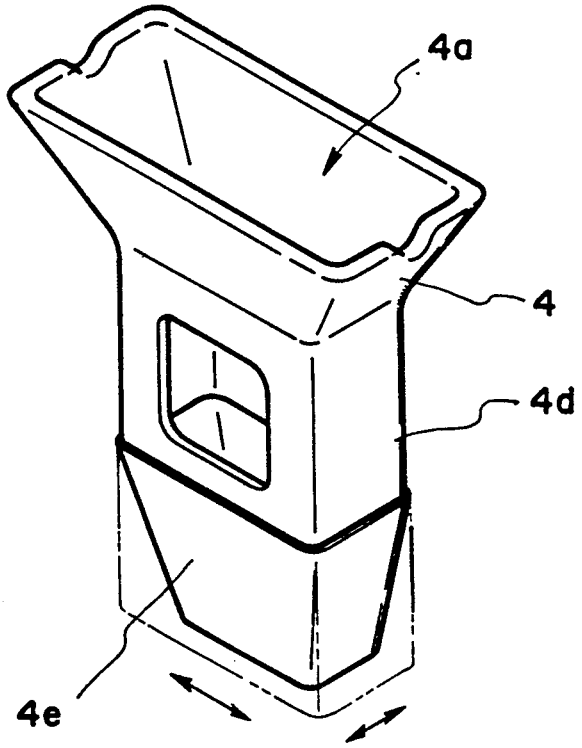
FIG. 4 is a perspective view of another embodiment of an auxiliary according to the present invention.
Figure 5:
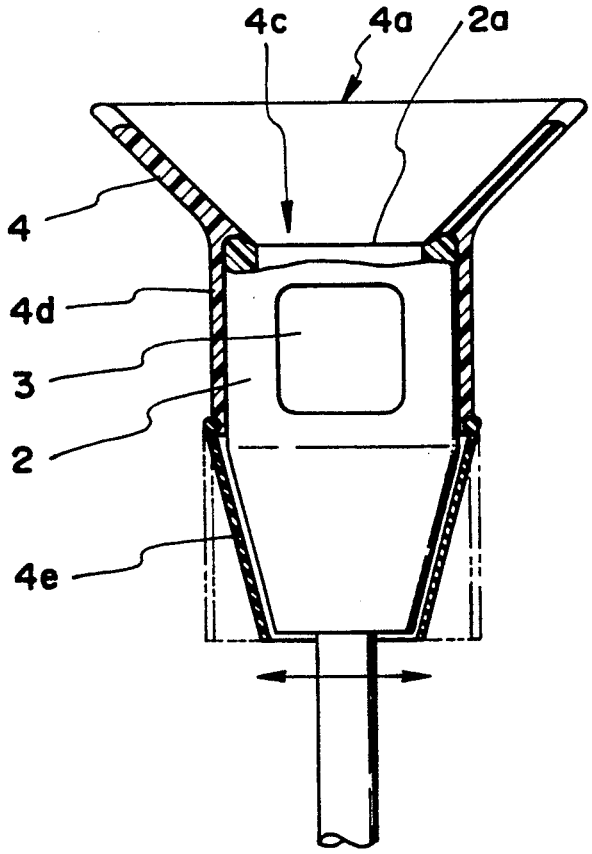
FIG. 5 is a cross-sectional view showing the guide member of FIG. 4 to a buckle.

In the embodiment shown in FIGS. 4 and 5, an accommodation member 4*d* is connected to the lower portion of the guide member 4 to receive the upper portion of the buckle 2. Further, a tapered securing member 4*e* made of elastic material such as rubber is furnished in such a manner that the guide member 4 inadvertently removed from the buckle 2. As shown in FIG. 5, the upper portion of the securing member 4*e* has a larger periphery than the lower portion thereof.

Figure 6:
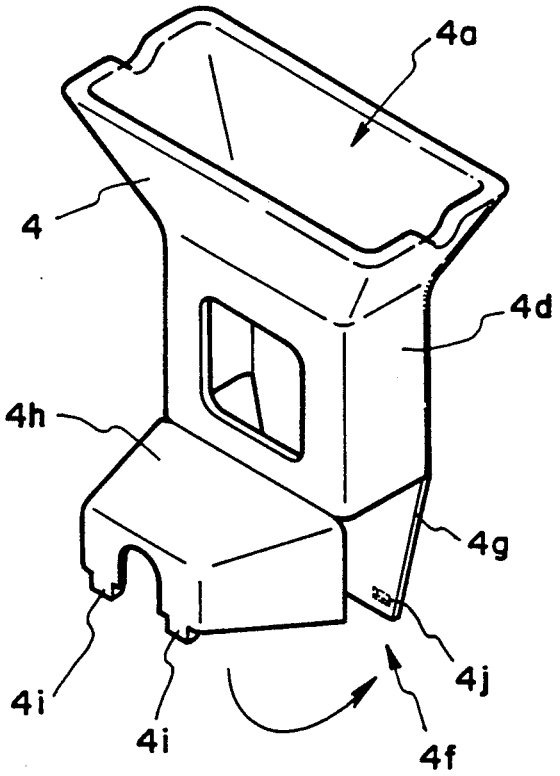
FIG. 6 is a perspective view of yet another embodiment of an auxiliary guide member according to the present invention.
Figure 7:
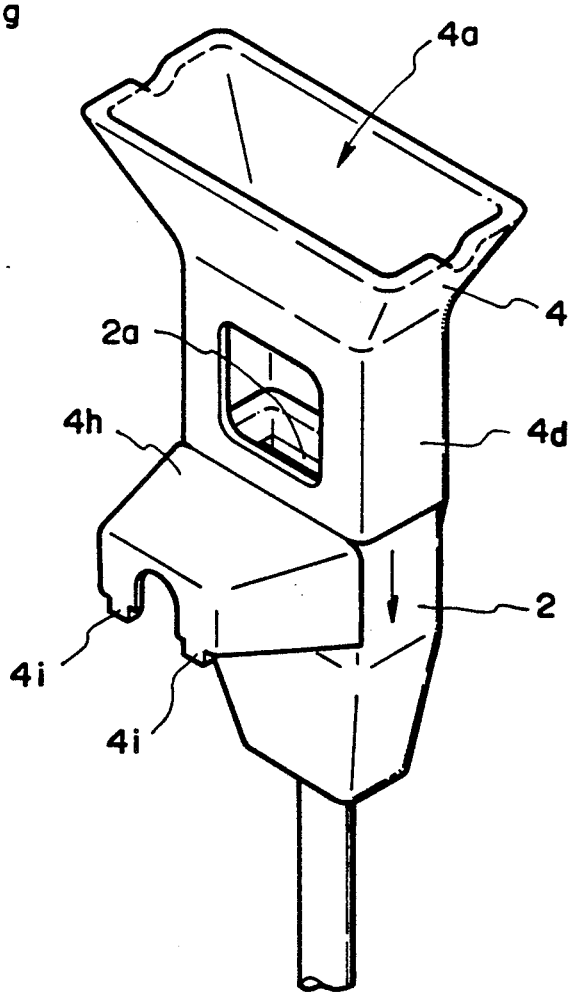
FIG. 7 and FIG. 8 are a perspective view and a cross-sectional view respectively showing the guide member of FIG. 6 mounted to a buckle.
Figure 8:
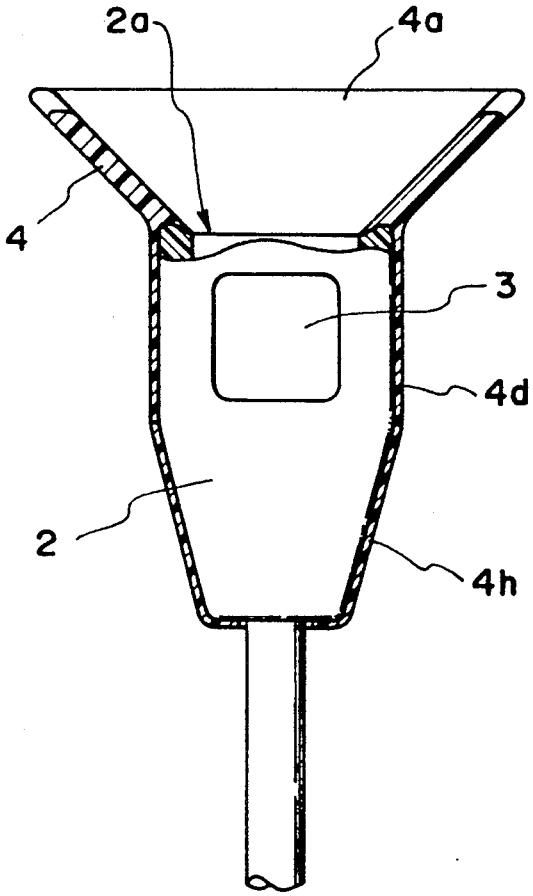

In the embodiment shown in FIGS. 6, 7 and 8, an enclosure member 4*f* is furnished on the lower portion of the accommodation member 4*d* to enclose the lower portion of the buckle 2. The enclosure member 4*f* comprises a plate member 4*g* to cover the back portion of the buckle 2 and a plate member 4*h* to cover the left and the right sides, the front side and the bottom of the buckle 2. The plate members 4*g* and 4*h* are respectively provided with engagement members 4*i* and 4*j* which are engageable with one another.

Because the trumpet-like guide member for tongue insertion and guide member are present toward the opening edge for tongue insertion on this buckle, it is possible to put on the seat belt more rapidly and smoothly than in conventional type products before starting the car, or in the case where the car is started without wearing seat belt because the driver has had no time to put it on before driving the car to open road or because the driver has forgotten to put it on. Even in such case, it is possible to put seat belt on while watching the road ahead of the car and without watching the seat belt for inserting and engaging the tongue. Thus, using the guide member for tongue insertion, the seat belt can be engaged and fixed easily as well as conveniently. This will further contribute to the elimination or reduction of the traffic accidents often caused by the driver, who wants to put seat belt on during driving.

What is claimed is:

1. A buckle apparatus for use with an automobile seat belt having a buckle and a tongue insertable in the buckle, comprising:

a trumpet-like guide member for guiding the seat belt tongue toward an insertion opening of the seat belt buckle, said trumpet-like guide member having an upper portion and a lower portion;

an accommodation member connected to said lower portion of said trumpet-like guide member to accommodate an upper portion of an outer periphery of the buckle of the seat belt, said accommodation member having an upper portion and a lower portion; and a securing member connected to said lower portion of said accommodation member for tightly securing said accommodation member and said trumpet-like guide member to the buckle of the seat belt.

2. A buckle apparatus as recited in claim 1, wherein said securing member is formed of an elastic material.

3. A buckle apparatus as recited in claim 2, wherein said elastic material comprises rubber.

4. A buckle apparatus as recited in claim 2, wherein said trumpet-like guide member is distinct and formed separately from the buckle of the seat belt.

5. A buckle apparatus as recited in claim 1, wherein said trumpet-like guide member is distinct and formed separately from the buckle of the seat belt.

6. A buckle apparatus as recited in claim 1, wherein said upper portion of said guide member defines an upper insertion opening, and said lower portion of said guide member defines a lower opening smaller than said upper insertion opening.

7. A buckle apparatus as recited in claim 1, wherein said securing member includes an upper portion connected to said lower portion of said accommodation member, and a lower portion; and said securing member comprises a tapered element such that said upper portion of said securing member has a larger periphery than said lower portion of said securing member.

8. A buckle apparatus as recited in claim 1, wherein said upper portion of said trumpet-like guide member has a larger periphery than said upper portion of said accommodation member.

9. A buckle apparatus for use with an automobile seat belt having a buckle and a tongue insertable in the buckle, comprising:

a trumpet-like guide member for guiding the seat belt tongue toward an insertion opening of the seat belt buckle, said trumpet-like guide member having an upper portion and a lower portion;

an accommodation member connected to said lower portion of aid trumpet-like guide member to accommodate an upper portion of an outer periphery of the buckle of the seat belt, said accommodation member having an upper portion and a lower portion; and an enclosure member, connected to said lower portion of said accommodation member and having a shape adapted to be complementary with a lower portion of the buckle of the seat belt, for releasably enclosing the lower portion of the buckle of the seat belt, said enclosure member including a first plate member movably attached to said lower portion of said accommodation member on one side thereof for movement between an enclosing position in which it is adapted to partially enclose the buckle and a release position disposed upwardly of said enclosing position, and a second plate member attached to said lower portion of said accommodation member on another side thereof.

10. A buckle apparatus as recited in claim 9, wherein said trumpet-like guide member is distinct and formed separately from the buckle of the seat belt.

11. A buckle apparatus as recited in claim 9, wherein said first plate member is provided with a first engagement member, and second plate member is provided with a second engagement member engageable with said first engagement member when said first plate member is in said enclosing position.

12. A buckle apparatus as recited in claim 9, wherein said upper portion of said guide member defines an upper insertion opening, and said lower portion of said guide member defines a lower opening smaller than said upper insertion opening.

13. A buckle apparatus as recited in claim 9, wherein said upper portion of said trumpet-like guide member has a larger periphery than said upper portion of said accommodation member.

14. A buckle apparatus for use with an automobile seat belt having a buckle and a tongue insertable in the buckle, comprising:

a trumpet-like guide member for guiding the seat belt tongue toward an insertion opening of the seat belt buckle, said trumpet-like guide member having an outermost lower peripheral portion shaped complementarily with an upper peripheral portion of the insertion opening of the seat belt buckle; and an adhesive disposed on said outermost lower peripheral portion of said trumpet-like guide member for fixing said trumpet-like guide member to the upper peripheral portion of the insertion opening of the seat belt buckle.

15. A buckle apparatus as recited in claim 14, wherein said adhesive comprises a double-sided adhesive tape.

16. A buckle apparatus as recited in claim 14, wherein said trumpet-like guide member is distinct and formed separately from the buckle of the seat belt.

17. A buckle apparatus as recited in claim 14, wherein said upper portion of said guide member defines an upper insertion opening, and said lower portion of said guide member defines a lower opening smaller than said upper insertion opening.

* * * * *